US010549137B2

(12) United States Patent
Tousant

(10) Patent No.: US 10,549,137 B2
(45) Date of Patent: Feb. 4, 2020

(54) PENDULUM JUMP ROPE

(71) Applicant: Greg Tousant, Los Angeles, CA (US)

(72) Inventor: Greg Tousant, Los Angeles, CA (US)

( * ) Notice: Subject to any disclaimer, the term of this patent is extended or adjusted under 35 U.S.C. 154(b) by 115 days.

(21) Appl. No.: 15/801,145

(22) Filed: Nov. 1, 2017

(65) Prior Publication Data

US 2019/0126086 A1 May 2, 2019

(51) Int. Cl.
*A63B 5/20* (2006.01)

(52) U.S. Cl.
CPC ..... *A63B 5/20* (2013.01); *A63B 2209/00* (2013.01); *A63B 2225/09* (2013.01)

(58) Field of Classification Search
CPC .. A63B 5/00; A63B 5/20; A63B 5/205; A63B 5/22; A63B 21/0004; A63B 21/00043; A63B 21/00058; A63B 21/00069; A63B 21/00072; A63B 21/00076; A63B 21/00178; A63B 21/00181; A63B 21/00185; A63B 21/00189; A63B 21/02; A63B 21/021; A63B 21/022; A63B 21/023; A63B 21/025; A63B 21/026; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/068; A63B 21/08; A63B 21/15; A63B 21/151; A63B 21/159; A63B 21/4017; A63B 21/4019; A63B 21/4021; A63B 21/4023; A63B 21/4025; A63B 21/4027; A63B 21/4033; A63B 21/4035; A63B 21/4041; A63B 21/4043; A63B 21/4045; A63B 21/4047; A63B 21/4049; A63B 2209/00; A63B 2210/00; A63B 2210/50; A63B 2210/58; A63B 2225/09; A63B 2225/093
See application file for complete search history.

(56) References Cited

U.S. PATENT DOCUMENTS 1,817,616 A * 8/1931 Goff ..... A63B 5/20 482/82
3,072,402 A * 1/1963 McCombs ..... A63B 5/20 403/378
3,517,931 A * 6/1970 Kalish ..... A63B 5/20 482/82
3,958,802 A * 5/1976 Thornton ..... A63B 5/20 482/81

(Continued)

*Primary Examiner* — Gary D Urbiel Goldner
(74) *Attorney, Agent, or Firm* — Eric Kelly

(57) ABSTRACT

A pendulum jump rope for use in confined spaces is described; wherein this pendulum jump rope operates in back and forth pendulum motion such that a flexible elongate member of the pendulum jump rope never has to pass above a user's waist. In some embodiments, the pendulum jump rope may comprise a pair of principal elongate-members; and the flexible elongate-member; wherein the flexible elongate-member may join one of the principal elongate-members to the other principal elongate-member. Free ends of the pair of principal elongate-members may be grasped as handles by the user. Each of the principal elongate-members may also have a joint that is flexible but also resilient; wherein these joints may contribute to the pendulum motion of the flexible elongate member.

16 Claims, 9 Drawing Sheets

(56) References Cited

U.S. PATENT DOCUMENTS 4,094,502 A * 6/1978 Cook ..... A63B 5/20 482/81
4,135,713 A * 1/1979 Martin ..... A63B 5/20 482/81
4,496,146 A * 1/1985 Jackemeyer ..... A63B 5/20 206/315.1
4,505,474 A * 3/1985 Mattox ..... A63B 5/20 482/110
4,787,623 A * 11/1988 Cedar ..... A63B 21/0608 482/110
5,234,393 A * 8/1993 Heinrich ..... A63B 5/20 482/81
5,376,039 A * 12/1994 Balgin ..... A63H 13/14 446/307
5,620,397 A * 4/1997 Chieh ..... A63B 5/20 482/121
5,690,592 A * 11/1997 Heinrich ..... A63B 5/20 482/81
6,540,649 B1 * 4/2003 Niedrich ..... A63B 5/20 482/109
7,462,140 B1 * 12/2008 Lombardozzi ..... A63B 5/20 482/108
8,684,892 B1 * 4/2014 Ihli ..... A63B 5/20 482/81
9,056,216 B1 * 6/2015 Bouza ..... A63B 5/20
2007/0191194 A1 * 8/2007 Joy ..... A63B 5/20 482/81
2010/0248907 A1 * 9/2010 Kessler ..... A63B 5/20 482/82
2013/0040786 A1 * 2/2013 Heinrich ..... A63B 5/20 482/81
2013/0165299 A1 * 6/2013 Hunt ..... A63B 5/20 482/82
2014/0228180 A1 * 8/2014 Walker ..... A63B 5/20 482/82
2014/0243164 A1 * 8/2014 Suplee ..... A63B 5/20 482/82
2016/0067536 A1 * 3/2016 Carpinelli ..... A63B 5/20 482/82
2017/0050065 A1 * 2/2017 Carter ..... A63B 21/1645
2019/0046825 A1 * 2/2019 Xu ..... A63B 21/4035

* cited by examiner

PENDULUM JUMP ROPE

TECHNICAL FIELD OF THE INVENTION

The present invention relates in general to jump ropes and more specifically to pendulum jump ropes for use in confined spaces.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Jump ropes comprising a main flexible elongate member, of a fixed length, are well known in the relevant art. And it is further well known that such jump ropes are excellent equipment for exercising and/or fun.

However, due to the circular path (cylindrical or spherical paths in three dimensions) that such traditional jump ropes travel through while in use, e.g., repeatedly traveling entirely around the upright body of a human, use of such jump ropes requires there to be a significant buffer of "dead space" or "empty space" around the human user to avoid the jump rope hitting obstacles. For example, a room with too low ceilings (or low hanging light fixtures and/or smoke alarms or the like) and/or insufficient floor space due to furniture or other items, limits use of such traditional jump ropes. Thus, often such traditional jump ropes are used outdoors where more space may be typically found.

There is a need in the art for a jump rope that does not require to travel entirely around the upright body of the human user in the typical circular fashion as noted above, but that may instead may travel in a back-and-forth pendulum motion that does not ever require the jump rope to travel above a height of the user's waist.

It is to these ends that the present invention has been developed.

BRIEF SUMMARY OF THE INVENTION

To minimize the limitations in the prior art, and to minimize other limitations that will be apparent upon reading and understanding the present specification, the present invention may describe pendulum jump ropes for use in confined spaces. Such pendulum jump ropes may operate in a back and forth pendulum motion, such that a flexible elongate member of the pendulum jump rope never has to pass above a user's waist. In some embodiments, the pendulum jump rope may comprise a pair of principal elongate-members; and the flexible elongate-member; wherein the flexible elongate-member may join one of the principal elongate-members to the other principal elongate-member. Free ends of the pair of principal elongate-members may be grasped as handles by the user. Each of the principal elongate-members may also have a joint that is flexible but also resilient; wherein these joints may contribute to the pendulum motion of the flexible elongate member.

It is an objective of the present invention to provide a jump rope that may be used in a back and forth pendulum motion, without ever require the jump rope to travel above a height of the user's waist.

It is another objective of the present invention to provide such a pendulum jump rope wherein certain elongate members may be varied in length to accommodate different sized users.

It is yet another objective of the present invention such a pendulum jump rope wherein a flexible elongate-member may be removable to facilitate replacement.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

REFERENCE NUMERALS

Figure 1A:
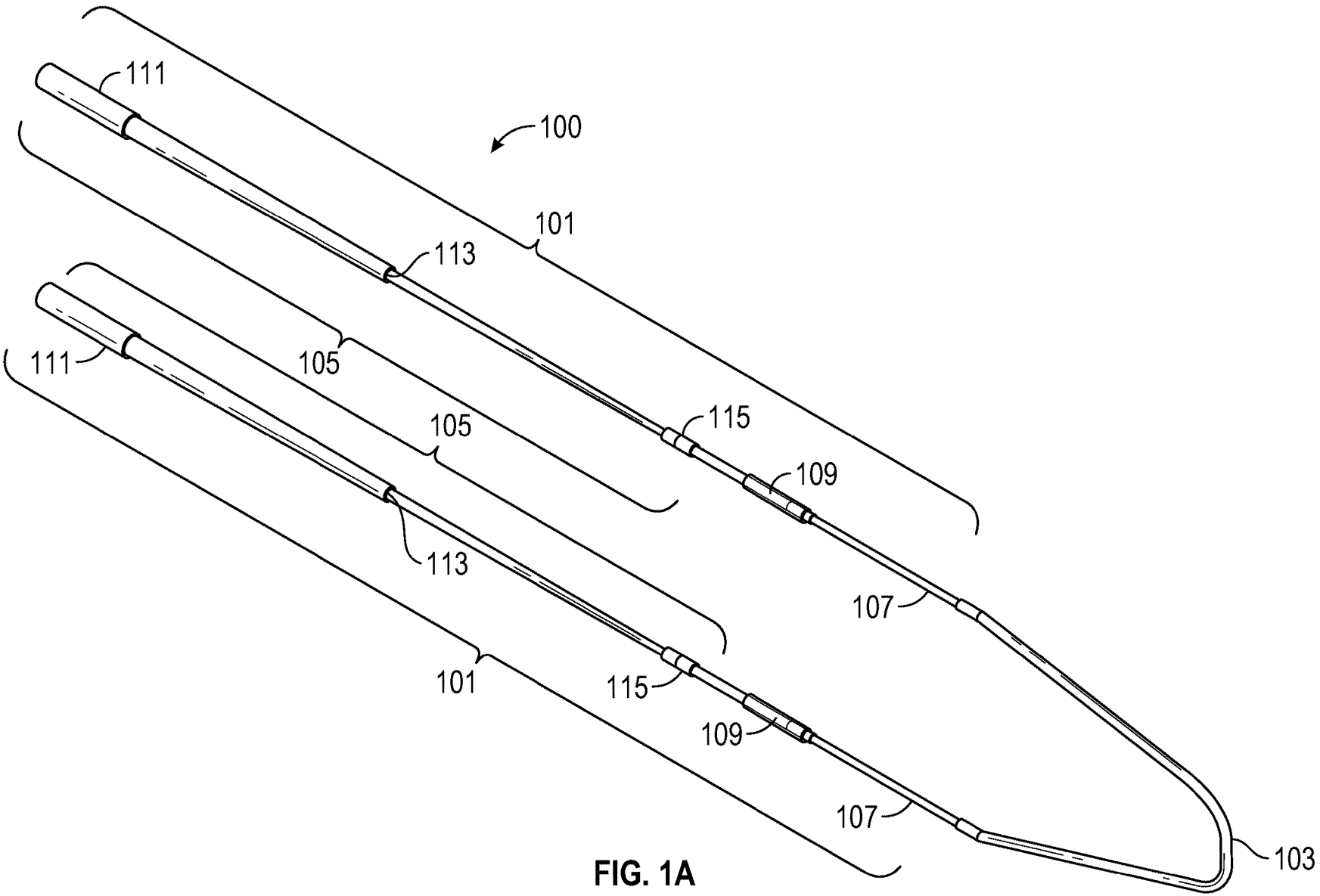
FIG. 1A may depict a perspective view of an embodiment of a pendulum jump rope.

100 pendulum jump rope 100
101 principal elongate-members 101
103 flexible elongate-member 103
105 first-elongate-member 105
107 second-elongate-member 107
109 joint 109
111 handle 111
113 telescoping mechanics 113
115 folding mechanics 115

205*a* first-elongate-member-first-portion 205*a*
205*b* first-elongate-member-second-portion 205*b*
400 pendulum jump rope 400

DETAILED DESCRIPTION OF THE INVENTION

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

Figure 1B:
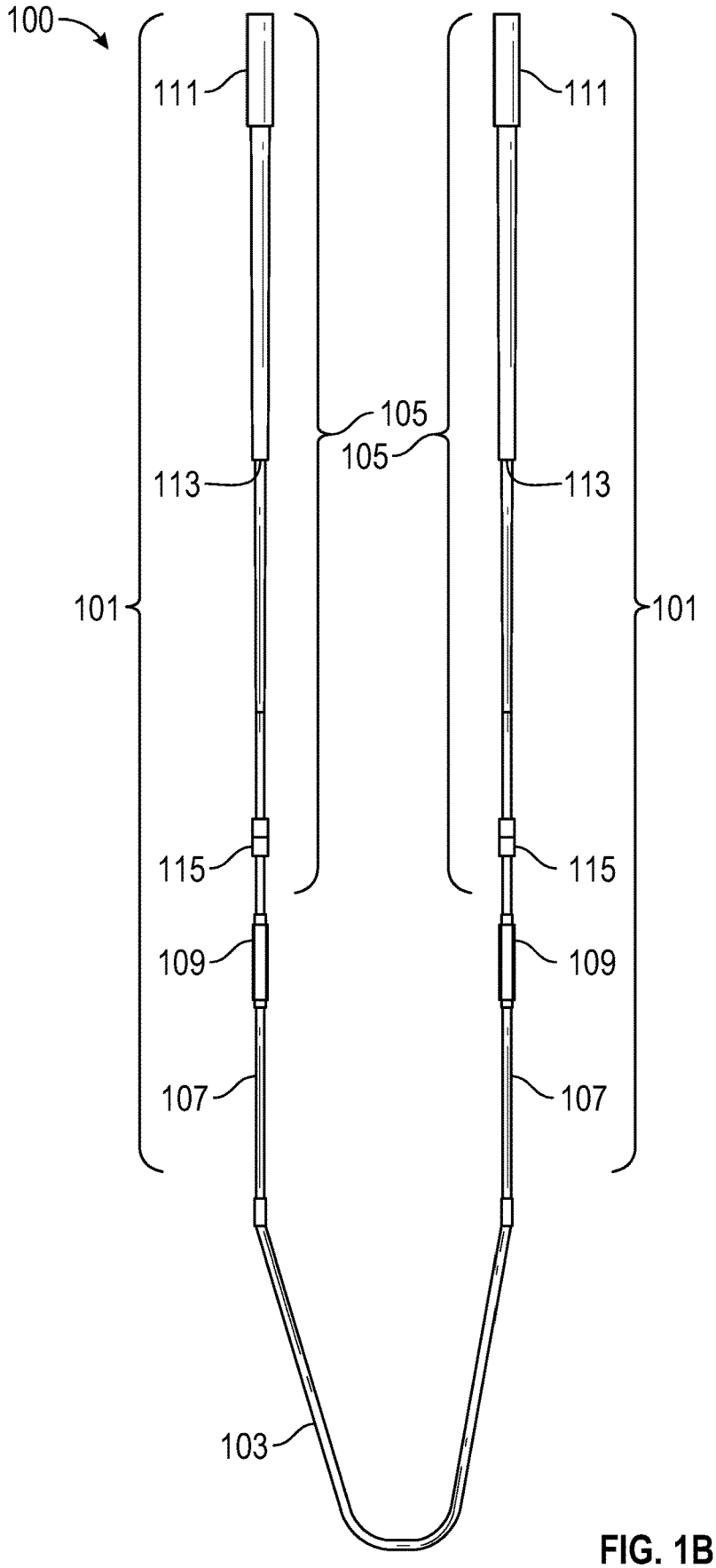
FIG. 1B may depict a top (or a bottom) view of the pendulum jump rope of FIG. 1A. (The top view and the bottom view may be substantially symmetrical with respect to each other.)
Figure 1C:
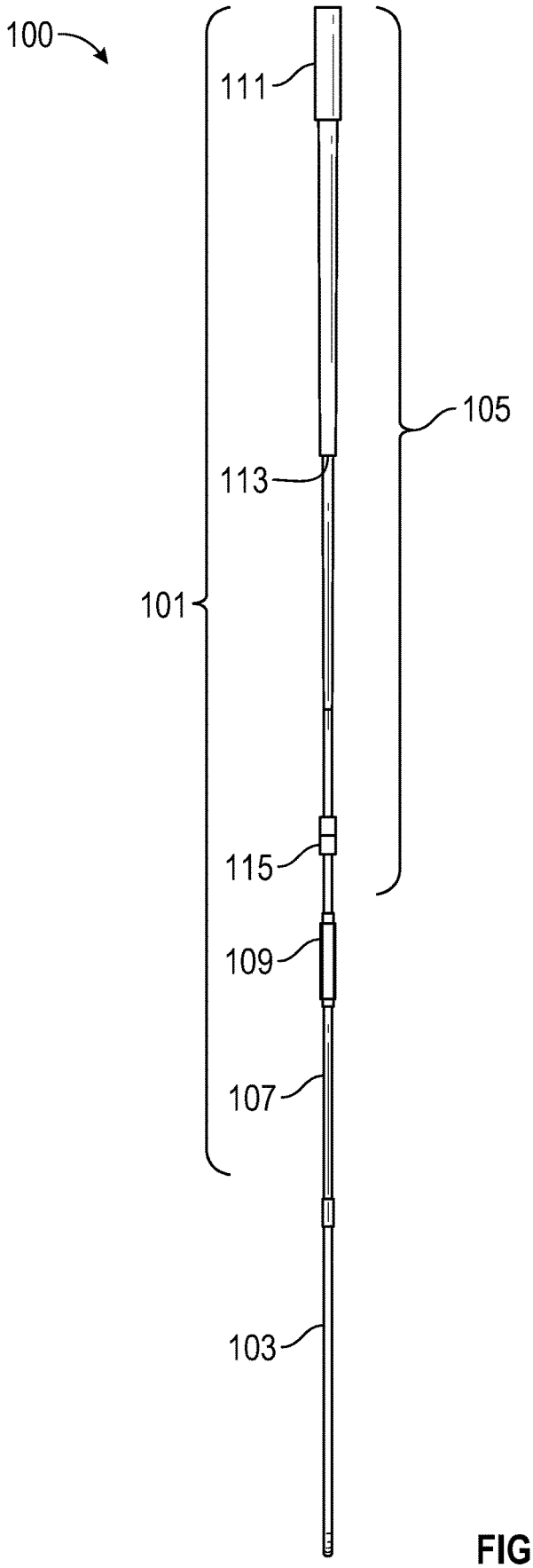
FIG. 1C may depict a left (or a right) length side view of the pendulum jump rope of FIG. 1A. (The left length side view and the right length side view may be substantially symmetrical with respect to each other.)
Figure 1D:
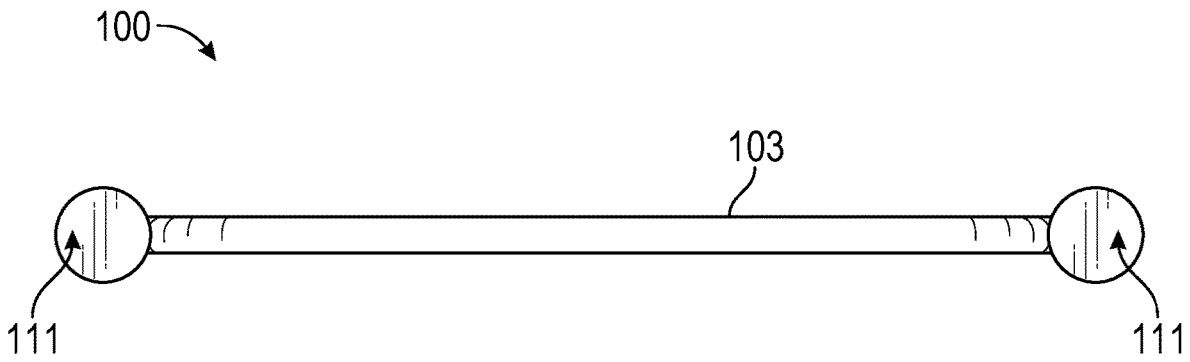
FIG. 1D may depict a front view of the pendulum jump rope of FIG. 1A.
Figure 1E:
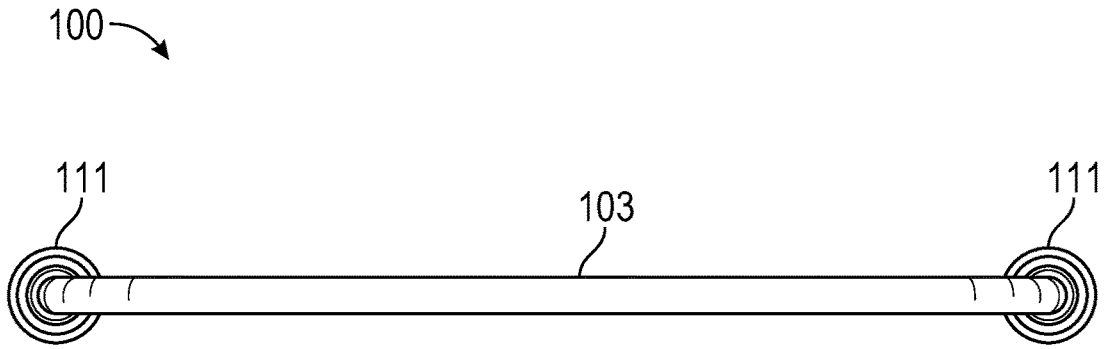
FIG. 1E may depict a back (rear) view of the pendulum jump rope of FIG. 1A.

FIG. 1A may depict a perspective view of an embodiment of a pendulum jump rope 100. FIG. 1B may depict a top (or a bottom) view of pendulum jump rope 100. (In some embodiments, the top view and the bottom view of pendulum jump rope 100 may be substantially symmetrical with respect to each other.) FIG. 1C may depict a left (or a right) length side view of pendulum jump rope 100. (In some embodiments, the left length side view and the right length side view of pendulum jump rope 100 may be substantially symmetrical with respect to each other.) FIG. 1D may depict a front view of pendulum jump rope 100. FIG. 1E may depict a back (rear) view of pendulum jump rope 100. Note, pendulum jump rope 100 may also be referred to as jump rope 100 herein, which may still have the pendulum function/action of flexible elongate-member 103.

Discussing FIG. 1A, in some embodiments, jump rope 100 may comprise a pair of principal elongate-members 101; and a flexible elongate-member 103; wherein flexible elongate-member 103 may join one of the principal elongate-members 101 to the other principal elongate-member 101. In some embodiments, jump rope 100 may comprise two principal elongate-members 101 and one (or at least one) flexible elongate-member 103. In some embodiments, flexible elongate-member 103 is connected to each of the two principal elongate-members 101, disposed in between them. In some embodiments, each principal elongate-member 101 may be of a predetermined length. For example, and without limiting the scope of the present invention, the predetermined length of a given principal elongate-member 101 may be about 40 inches plus or minus six inches. In some embodiments, flexible elongate-member 103 may be of a predetermined length.

Continuing discussing FIG. 1A, in some embodiments, each of the pair of principal elongate-members 101 may comprise a first-elongate-member 105; a second-elongate-member 107; and a joint 109. In some embodiments, joint 109 may connect first-elongate-member 105 to second-elongate-member 107. In some embodiments, joint 109 may be flexible and resilient. In some embodiments, joint 109 may be flexible and elastic. For example, and without limiting the scope of the present invention, in some embodiments, joint 109 may comprise a spring (as in a cylindrical coil spring, see e.g., joint 109 in jump rope 400 of FIG. 4). For example, and without limiting the scope of the present invention, in some embodiments, joint 109 may comprise a section of hollow sheathing of elastomer (such as, but not limited to, silicone, rubber, or plastic) (see e.g., FIG. 1A, FIG. 1B, and FIG. 1C). In some embodiments, such a hollow sheathing of elastomer may be manufactured by extrusion followed by cutting to predetermined length. In some embodiments, joint 109 may be located closer to flexible elongate-member 103 than to handle 111. In some embodiments, joint 109's flexibility, but with resilience and/or elasticity, may be critical for the back and forth arcing pendulum motion imparted to flexible elongate-member 103 during use of jump rope 100.

Continuing discussing FIG. 1A, in some embodiments, first-elongate-member 105 and second-elongate-member 107 may each be rigid to semi-rigid. In some embodiments, first-elongate-member 105 and second-elongate-member 107 may each be substantially constructed from elongate plastic members (which may be substantially hollow in some embodiments); elongate metal members; and/or elongate wood members. In some embodiments, first-elongate-member 105 may be of a predetermined length (which may be fixed or variable depending upon the embodiment). In some embodiments, second-elongate-member 107 may be of a predetermined length (which may be fixed or variable depending upon the embodiment).

Continuing discussing FIG. 1A, in some embodiments, an end second-elongate-member 107 that may be disposed away from joint 109 may be attached to flexible elongate-member 103. In some embodiments, attachment of an end of flexible elongate-member 103 to an end of second-elongate-member 107 may be by: friction fit; chemical adhesive; solvent bonding; ultrasonic bonding; heat welding; mechanical fastener (including, but not limited to crimping, screws, bolts, etc.); and/or the like. For example, and without limiting the scope of the present invention, a friction fit may be accomplished by an elastomeric end of flexible elongate-member 103 slipping over and gripping by friction the end of second-elongate-member 107. For example, and without limiting the scope of the present invention, a friction fit may be accomplished by an elastomeric end of second-elongate-member 107 slipping over and gripping by friction the end of flexible elongate-member 103. In some embodiments, attachment of an end of flexible elongate-member 103 to an end of second-elongate-member 107 may be removable (which may facilitate replacement of flexible elongate-member 103).

In some embodiments, attachment of an end of flexible elongate-member 103 to an end of second-elongate-member 107 may be intended to be permanent.

Continuing discussing FIG. 1A, in some embodiments, an end first-elongate-member 105 that may be disposed away from joint 109 may comprise a handle 111. In some embodiments, handle 111 may be removably gripped by a hand of a user of jump rope 100. In some embodiments, handle 111 is may be cylindrical member of a predetermined length. In some embodiments, handle 111 may be substantially covered by foam; as this may provide greater comfort for the user; which in turn may allow the user to use jump rope 100 for longer periods of time without hand fatigue or hand cramping.

Continuing discussing FIG. 1A, in some embodiments, a length of first-elongate-member 105 may be variable within predetermined limits. This may allow users (e.g., humans) of different heights, different leg lengths, and/or different arm lengths to utilize a same given jump rope 100. In some embodiments, the length of first-elongate-member 105 that may be variable within the predetermined limits, may be so variable in length by telescoping mechanics 113 of first-elongate-member 105. For example, and without limiting the scope of the present invention, in some embodiments, telescoping mechanics 113 may function by a portion of first-elongate-member 105 (e.g., a portion of about 12 inches plus or minus two inches) fitting into a different portion of first-elongate-member 105 (e.g., a portion of about 18 inches plus or minus two inches), such these two portions (of first-elongate-member 105) may slide by a concentric friction fit with respect to these two portions of first-elongate-member 105.

Note, in some embodiments, a given jump rope 100 may not comprise telescoping mechanics 113 of first-elongate-member 105.

In some embodiments, telescoping mechanics 113 may be located in second-elongate-member 107, in a fashion similar to 113 being located in first-elongate-member 105 as shown in FIG. 1A.

Continuing discussing FIG. 1A, in some embodiments, along a length of the first-elongate-member 105 may be a folding mechanics member 115 (e.g., a hinge) allowing first-elongate-member 105 to be folded onto itself. Note in some embodiments, folding mechanics member 115 may be absent from jump rope 100 or absent from jump rope 400.

Continuing discussing FIG. 1A, in some embodiments, flexible elongate-member 103, at each of its ends, may be attached to two different of second-elongate-members 107. In some embodiments, flexible elongate-member 103, at each of its ends, may be removably attached to two different of second-elongate-members 107. In some embodiments, flexible elongate-member 103 may be flexible. In some embodiments, flexible elongate-member 103 may be substantially constructed from one or more of: silicone tubing, rubber tubing, plastic tubing, elastic tubing, surgical tubing, rubber band, rubber ribbon, elastic ribbon, elastic band, rope, cordage, string, yarn, ribbon, band, threads, and/or the like. In some embodiments, flexible elongate-member 103 may be substantially constructed from one or more elastomers. In some embodiments, flexible elongate-member 103 may be of a predetermined length.

Figure 2:
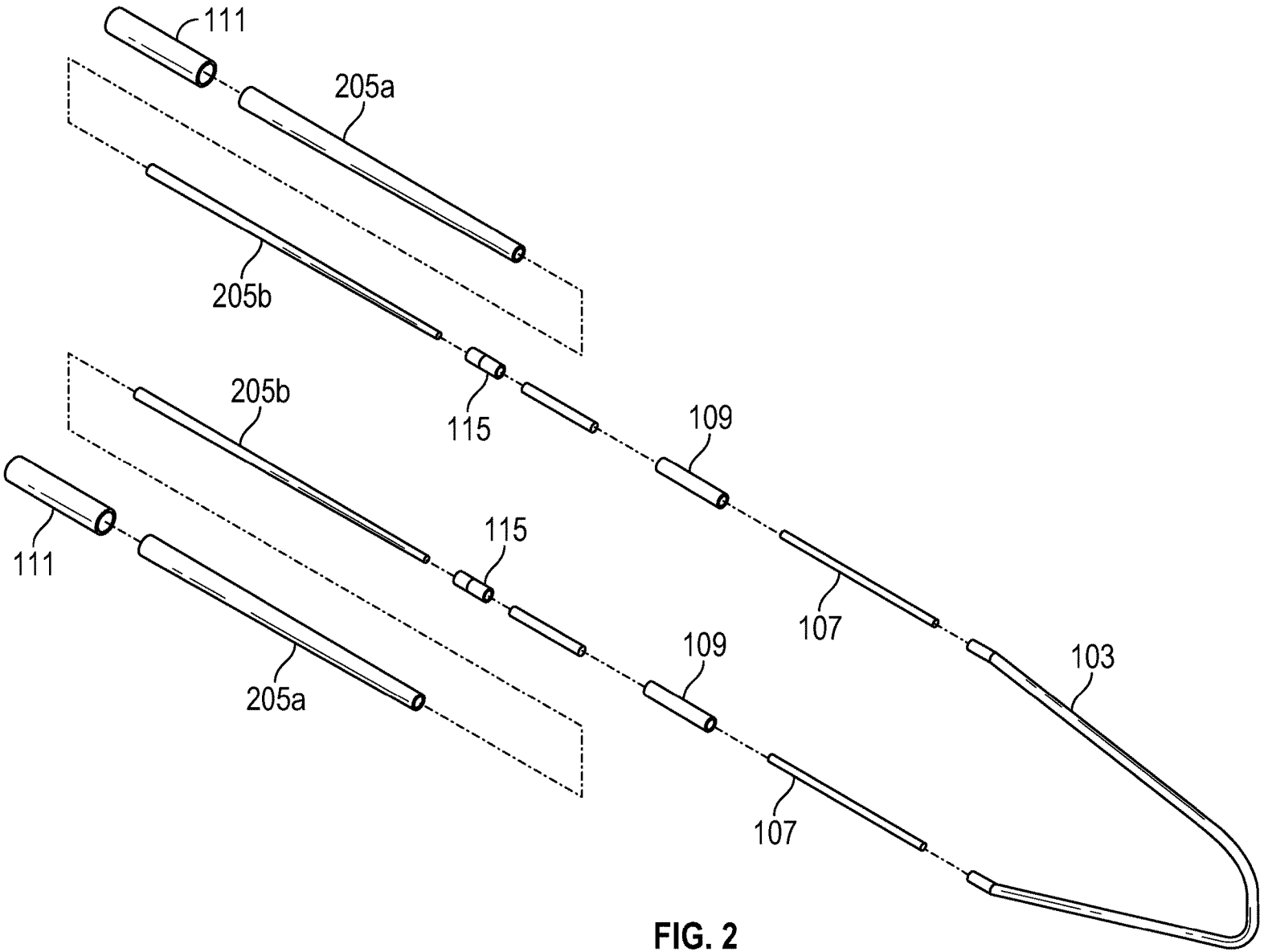
FIG. 2 may depict an exploded perspective view of an embodiment of a pendulum jump rope.

FIG. 2 may depict an exploded perspective view of pendulum jump rope 100. In some embodiments, first-elongate-member 105 may be two separate slidingly coupled (for telescoping mechanics) elongate members of first-elongate-member-first-portion 205*a* and of first-elongate-member-second-portion 205*b*; wherein first-elongate-member-second-portion 205*b* may slidingly telescope into first-elongate-member-first-portion 205*a*, so that the overall length of first-elongate-member 105 may be adjusted.

Figure 3A:
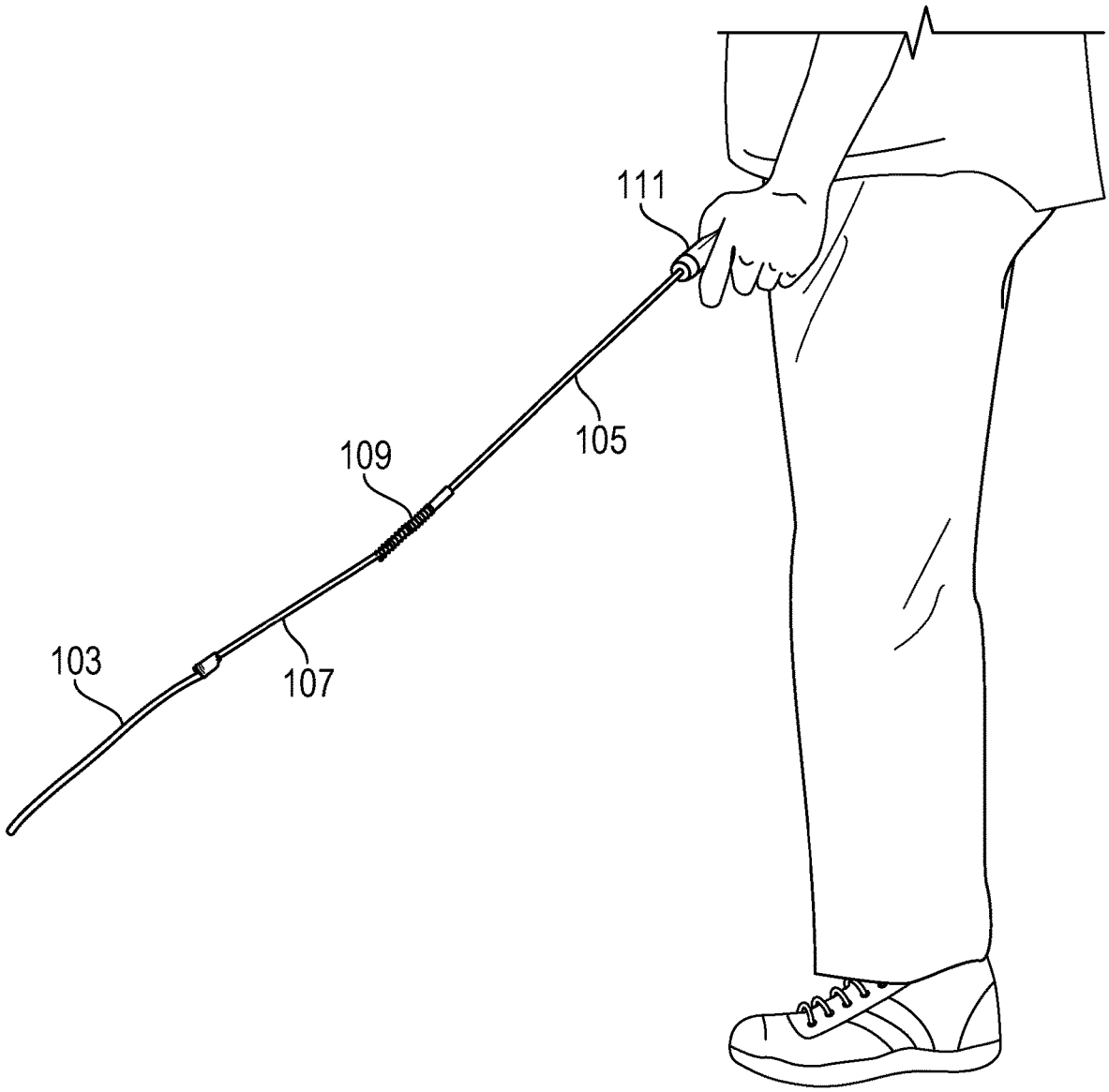
FIG. 3A may depict an embodiment of a pendulum jump rope in use.
Figure 3B:
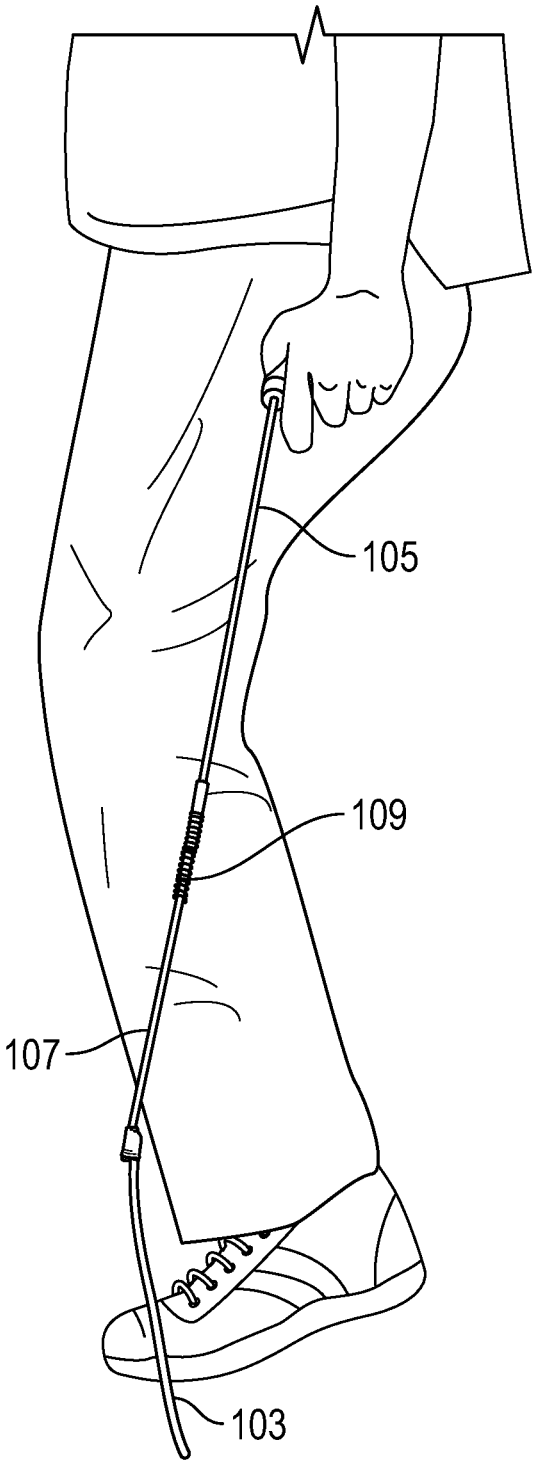
FIG. 3B may depict the pendulum jump rope of FIG. 3A in use, but showing a flexible elongate-member at a different location.
Figure 3C:
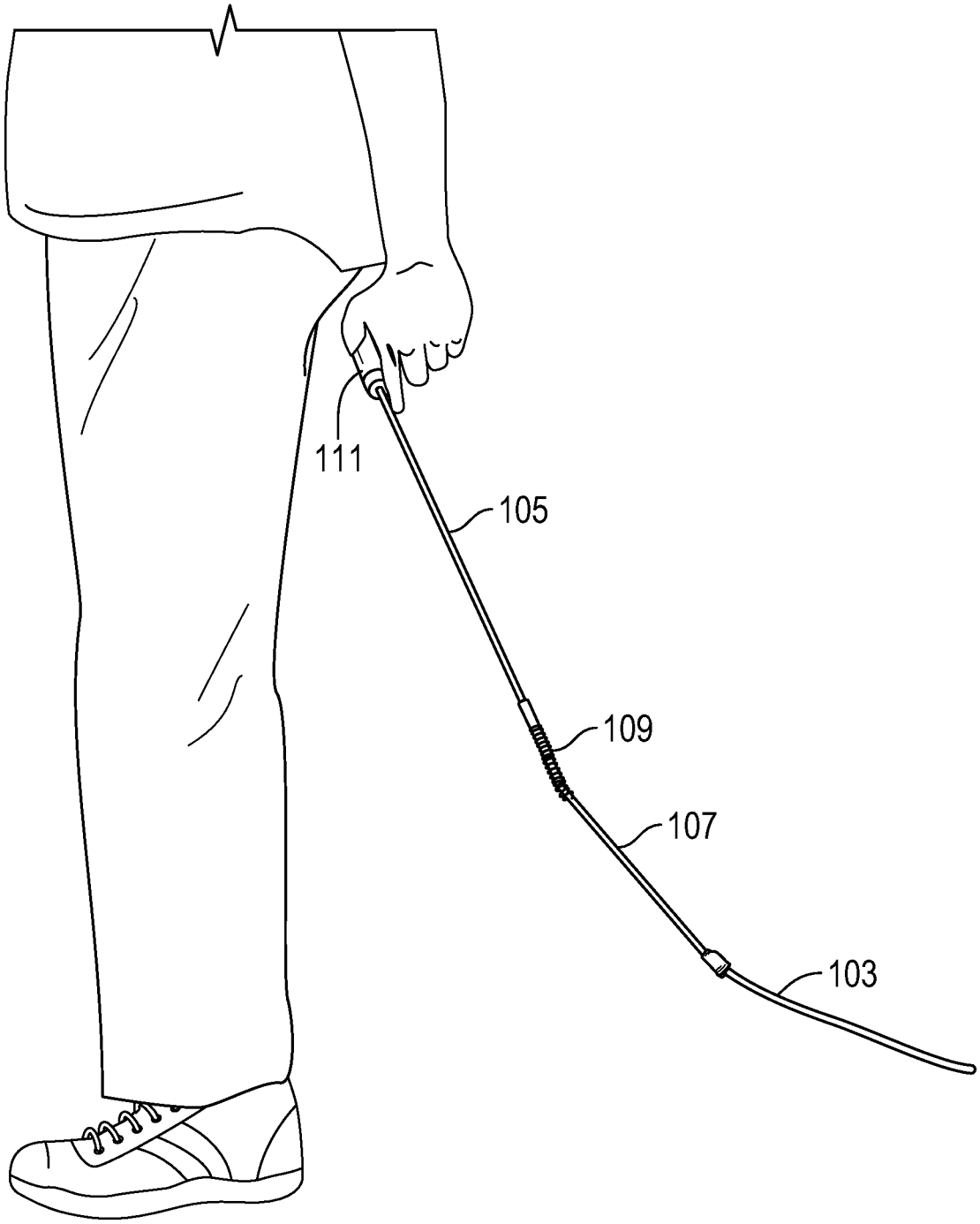
FIG. 3C may depict the pendulum jump rope of FIG. 3A in use, but showing the flexible elongate-member at another different location.

FIG. 3A may depict an embodiment of a pendulum jump rope 400 in use, e.g., with flexible elongate-member 103 in front of the user. FIG. 3B may depict pendulum jump rope 400 in use, but showing flexible elongate-member 103 at a different location as compared against FIG. 3A. In FIG. 3B, flexible elongate-member 103 may be at a location such that the user may jump (or step) over flexible elongate-member 103. FIG. 3C may depict pendulum jump rope 100 in use, but showing flexible elongate-member 103 at yet another different location (e.g., behind the user). In some embodiments, during use, jump rope 400 (or jump rope 100) may alternate from about the position of flexible elongate-member 103 shown in FIG. 3A, then to about the position of flexible elongate-member 103 shown in FIG. 3B, then to about the position of flexible elongate-member 103 shown in FIG. 3C, and then back to about the position of flexible elongate-member 103 shown in FIG. 3B, and so on in such a back and forth manner. Note, in some embodiments, during use flexible elongate-member 103 need not go above the user's waist level or above the user's chest level.

FIG. 3A, FIG. 3B, and FIG. 3C may depict a method of using pendulum jump rope 400 (or of pendulum jump rope 100). Such a method of use may comprise the steps of: (a) each handle 111 being removably held in a separate hand of the user; (b) switching flexible elongate-member 103 from a front side to a back side of the user, and then back to the front side, in back and forth manner; and (c) with the user jumping or stepping over flexible elongate-member 103 as flexible elongate-member 103 is brought repeatedly into proximity of the user's feet.

Figure 4:
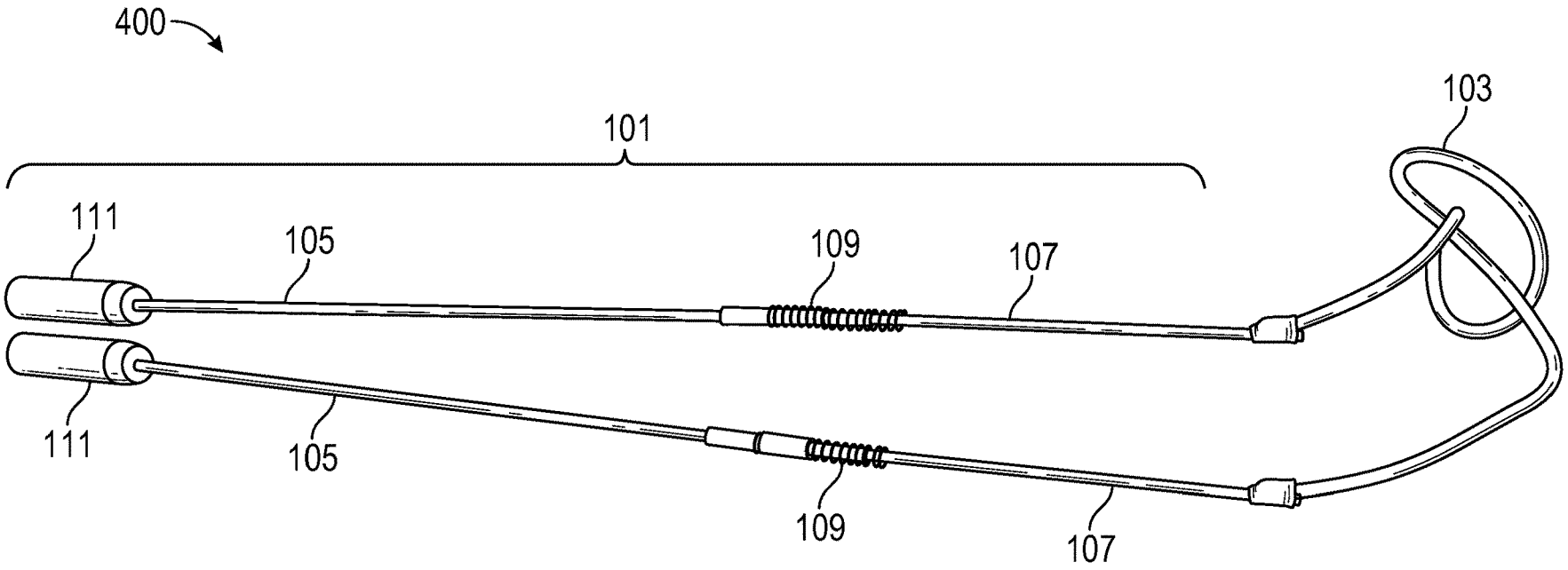
FIG. 4 may depict a perspective view of an embodiment of a pendulum jump rope.

FIG. 4 may depict a perspective view of an embodiment of a pendulum jump rope 400. In some embodiments, jump rope 400 may comprise a pair of principal elongate-members 101; and a flexible elongate-member 103; wherein flexible elongate-member 103 may join one of the principal elongate-members 101 to the other principal elongate-member 101. In some embodiments, jump rope 100 may comprise two principal elongate-members 101 and one (or at least one) flexible elongate-member 103. In some embodiments, flexible elongate-member 103 is connected to each of the two principal elongate-members 101, disposed in between them. In some embodiments, each principal elongate-member 101 may be of a predetermined length. For example, and without limiting the scope of the present invention, the predetermined length of a given principal elongate-member 101 may be about 40 inches plus or minus six inches. In some embodiments, flexible elongate-member 103 may be of a predetermined length. In some embodiments, principal elongate-member 101 and flexible elongate-member 103 of jump rope 400 may be as described for jump rope 100 above. In some embodiments, joint 109 of jump rope 400 may comprise a cylindrical coil spring; wherein this spring may provide the flexible and resilient functions of joint 109.

Note, both jump rope 100 and jump rope 400 may be used as a regular jump rope; wherein during use the jump rope passes overhead of the user, with flexible elongate-member 103 traveling entirely around the user. Or jump rope 100 and jump rope 400 may be used as pendulum jump ropes that move back and forth in a pendulum motion from the user's front to the user's back, without ever passing above the user's head, chest, or even waist.

Pendulum jump ropes and their uses have been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A pendulum jump rope configured to be operated in an alternating back and forth pendulum motion, wherein the pendulum jump rope comprises:

a pair of principal elongate-members, each principal elongate-member having a first-elongate-member with a free first end and an opposing second end, a second-elongate-member with opposing third and fourth ends, a joint connecting the second end of the first-elongate-member to the third end of the second-elongate-member, and a first length from the free first end of the first-elongate-member to the fourth end of the second-elongate-member; and a flexible elongate-member having a second length with two opposing ends respectively coupled to the fourth ends of the second-elongate-members;

wherein the first length is longer than the second length;

wherein the first-elongate-member and the second-elongate-member are each rigid; and wherein the respective first lengths and rigidity of the pair of principal elongate-members facilitates the alternating back and forth pendulum motion of the pendulum jump rope during use.

2. The pendulum jump rope according to claim 1, wherein the joint is flexible and resilient.

3. The pendulum jump rope according to claim 1, wherein the joint is flexible and elastic.

4. The pendulum jump rope according to claim 1, wherein the free first end of the first-elongate-member comprises a handle.

5. The pendulum jump rope according to claim 4, wherein the handle is a cylindrical member.

6. The pendulum jump rope according to claim 4, wherein the handle is substantially covered by foam.

7. The pendulum jump rope according to claim 4, wherein the handle is colinear with a portion of the first-elongate-member that does not include the handle.

8. The pendulum jump rope according to claim 1, wherein a length of the first-elongate-member is variable within predetermined limits.

9. The pendulum jump rope according to claim 8, wherein the length of the first-elongate-member is variable within predetermined limits by telescoping mechanics of the first-elongate-member.

10. The pendulum jump rope according to claim 9, wherein the telescoping mechanics function by a portion of the first-elongate-member fitting into a different portion of the first-elongate-member, such that the portion and the different portion slide by a concentric friction fit with respect to each other.

11. The pendulum jump rope according to claim 1, wherein along a length of the first-elongate-member is a folding mechanics member allowing the first-elongate-member to be folded onto itself.

12. The pendulum jump rope according to claim 1, wherein the two opposing ends of the flexible elongate-member are each removably coupled to the fourth ends of the second-elongate-members, respectively.

13. The pendulum jump rope according to claim 1, wherein the first-elongate-members and the second-elongate-members are substantially linearly straight.

14. The pendulum jump rope according to claim 1, wherein the first-elongate-member, the second-elongate-member, and the joint are each separate and distinct component parts of the pendulum jump rope.

15. The pendulum jump rope according to claim 1, wherein the flexible elongate-member is made from: rubber tubing, plastic tubing, elastic tubing, surgical tubing, rubber band, rubber ribbon, elastic ribbon, elastic band, rope, cordage, string, yarn, ribbon, band, or threads.

16. The pendulum jump rope according to claim 1, wherein each of the pair of principal elongate-members is substantially linearly straight.

* * * * *